US005542864A

United States Patent [19]

Peebles

[11] Patent Number: 5,542,864

[45] Date of Patent: Aug. 6, 1996

[54] STEERING CYLINDER FOR OUTBOARD ENGINES

[75] Inventor: D. Scott Peebles, Bradenton, Fla.

[73] Assignee: IMO Industries, Inc., Sarasota, Fla.

[21] Appl. No.: 288,561

[22] Filed: Aug. 10, 1994

[51] Int. Cl.[6] ..... B63H 20/12

[52] U.S. Cl. ..... 440/61; 91/450; 114/150

[58] Field of Search ..... 440/61; 114/150; 91/450

[56] References Cited

U.S. PATENT DOCUMENTS

| | | | |
|---|---|---|---|
| 1,503,782 | 8/1924 | Barnes | 92/169.1 |
| 2,625,115 | 1/1953 | Maloney | 103/175 |
| 2,678,247 | 5/1954 | Geyer et al. | 309/3 |
| 2,787,235 | 4/1957 | Schroeder | 114/150 |
| 2,855,755 | 10/1958 | Auger | 114/150 X |
| 3,132,569 | 5/1964 | Shepherd | 92/169 |
| 3,145,629 | 8/1964 | Gottzmann | 92/155 |
| 3,150,570 | 9/1964 | Johnson et al. | 92/28 |
| 3,156,160 | 11/1964 | Meyer et al. | 92/13 |
| 3,168,853 | 2/1965 | Prince | 91/167 |
| 3,180,236 | 4/1965 | Beckett | 92/164 |
| 3,368,751 | 2/1968 | Merrill | 235/201 |
| 3,650,182 | 3/1972 | Phillips | 96/128 |
| 3,886,849 | 6/1975 | Roberts et al. | 92/168 |
| 4,185,543 | 1/1980 | Ides | 92/128 |
| 4,568,292 | 2/1986 | Hall | 440/61 |
| 4,773,882 | 9/1988 | Rump | 440/61 |
| 4,836,812 | 6/1989 | Griffiths | 440/61 |
| 4,867,044 | 9/1989 | Holtrop | 92/169.1 |
| 4,977,760 | 12/1990 | Ishimori et al. | 60/444 |
| 5,014,603 | 5/1991 | Navarette et al. | 92/165 R |
| 5,149,285 | 9/1992 | Kinoshita | 440/61 |
| 5,156,561 | 10/1992 | Kinoshita | 440/61 |
| 5,340,341 | 8/1994 | Yoshimura | 440/61 |

*Primary Examiner*—Sherman Basinger
*Attorney, Agent, or Firm*—Jansson & Shupe, Ltd.

[57] ABSTRACT

The disclosure involves a hydraulic cylinder having an elongate interior chamber, a piston movable in the chamber, and a first fluid passage generally parallel to the chamber. In the improvement, the cylinder includes a second fluid passage generally parallel to the chamber and both passages terminate at faces at either end of the cylinder housing. Air bleed fittings and hydraulic fluid fittings are at the faces and because of such location, jammed and broken fittings and damage to the boat transom and other structure are substantially avoided. And since each passage has both bleed and fluid fittings, it is not necessary to "crack" a fluid fitting to bleed the cylinder during installation.

15 Claims, 5 Drawing Sheets

STEERING CYLINDER FOR OUTBOARD ENGINES

FIELD OF THE INVENTION

This invention is related generally to ships and boats and, more particularly, to vessel steering.

BACKGROUND OF THE INVENTION

Vessels used on water are steered in any of a variety of ways. One way, commonly used on seagoing vessels and on larger pleasure craft, is to have one, two or more "screws" or propellers turned by shafts, the orientations of which remain unchanged with respect to the vessel hull. Steering is by a separate rudder.

Another way commonly used with smaller pleasure craft is to pivot all or a part of the propulsion system so that the rotational axis of the propeller moves with respect to the vessel hull. On so-called inboard-outboard drives, only a portion of the propeller drive train pivots. However, on boats driven by outboard engines, the entire engine (but for its mounting bracket and the like) are pivoted on the rear transom of the boat. The invention relates to boats of this latter type and, particularly, relates to an apparatus for steering an outboard engine.

Smaller outboard engines are steered by an operator sitting at the rearmost seat and grasping the engine handle. Such handle not only pivots the engine about a generally vertical axis, it usually includes a twist-type throttle control. Thus, the operator controls vessel speed and direction with one hand.

For larger outboard engines, hand steering in the aforementioned manner is impractical. For one thing, the engine is simply too heavy to steer with one hand. And boats large enough to accept such an engine usually have steering and throttle controls at a forward seat location. The operator faces directly forward as when driving an automobile.

Larger outboard engines are often steered using some type of "force-multiplying" mechanism such as a steering wheel and control cable, the latter as made by Morse Controls and others. Or steering may be by hydraulic cylinder. In a common arrangement, the cylinder body is mounted in a fixed location and a cylinder rod is coupled to the engine tiller bar by a steering link. In another arrangement, the rods are at a fixed location and the cylinder body is coupled to the tiller bar for bar movement.

When a hydraulic cylinder is used, such cylinders are "double-ended" in that a cylinder rod protrudes from each end of the cylinder. A double-ended cylinder has equal areas under pressure for either steering direction and the control, e.g., the steering wheel, behaves symmetrically. In order to provide such function, "prior art" cylinders have a single connection, i.e., a pressure fitting, for each hydraulic line connected to the cylinder. Each such fitting connects directly to a separate chamber at each end of the cylinder piston.

When a cylinder is installed (as new or replacement equipment), the installer must use each pressure fitting alternately as a pressure inlet port and as a bleed port to exhaust air from the circuit. To say the least, this is quite time consuming—it is not uncommon for an hour or more to be required to install a steering cylinder.

Yet another disadvantage of certain known outboard engine steering cylinders is that the fittings are placed on the front face of the cylinder body and project toward the bow of the boat when the engine is in propulsion position. In certain other prior art embodiments, the fittings are positioned on the cylinder top surface and project upward from the cylinder. When the engine is tilted upward or moved from side to side, such fittings can become jammed into structural portions of the boat or the engine. Boat and/or fitting damage often results.

U.S. Pat. No. 5,149,285 (Kinoshita) shows an outboard engine arranged for tilting. The way in which fittings can become jammed will be apparent from an inspection of the Kinoshita patent.

Still another disadvantage of known outboard engine steering cylinders is that they or their mounting brackets are configured to fit but a single "brand" of outboard engine. Thus, the manufacturer is required to produce hardware in a variety of configurations, increasing manufactured costs. And if the distributor resolves to provide prompt service, such distributor must stock the same variety of configurations. Higher inventory and handling costs inevitably result.

An improved steering cylinder for outboard engines which addresses disadvantages of earlier steering cylinders would be an important advance in the art.

OBJECTS OF THE INVENTION

It is an object of this invention to provide an improved steering cylinder for outboard engines which overcomes some of the problems and shortcomings of steering cylinders of the prior art.

A further object of the invention is to provide an improved steering cylinder for outboard engines which reduces installation time.

Yet another object of the invention is to provide an improved steering cylinder for outboard engines in which the hydraulic fittings are positioned to avoid fitting damage.

It is also an object of the invention to provide an improved steering cylinder for outboard engines in which the hydraulic fittings are positioned to avoid damage to the boat and engine.

Another object of the invention is to provide an improved steering cylinder for outboard engines which avoids having to use the fittings as "double-duty" passages for pressurized fluid and as bleed outlet.

An additional object of the invention is to provide an improved steering cylinder for outboard engines which easily mounts to a variety of engine "brands."

Yet another object of the invention is to provide an improved steering cylinder for outboard engines which reduces manufacturer's and distributor's costs. How these and other objects are accomplished will become apparent from the following descriptions and from the drawing.

SUMMARY OF THE INVENTION

Briefly described, the present invention is an improved steering cylinder for outboard engines. The invention includes a hydraulic cylinder having an elongate interior chamber, a piston movable in the chamber, and two fluid passages generally parallel to the chamber. Fluid flows in the passages for controlling the position of the piston in the chamber. The piston moves in the chamber when the fluid pressure in one passage is elevated and the other passage is connected in "free flow" manner to tank.

Preferably the long axis of at least one passage is spaced from the long axis of the chamber. It is most preferred that the long axes of both passages are spaced from the long axis of the chamber and are spaced from one another. It is most highly preferred that the piston divide the chamber into first and second portions and that each passage is connected by a fluid path to one portion of the chamber.

In yet another preferred embodiment, the cylinder includes a housing having first and second end faces spaced from one another and each passage has a terminus at each end face. Each passage include a hydraulic flow fitting at the first end face and a bleed fitting at the second end face. Or, in the alternative, one passage has a flow fitting and a bleed fitting at the first and second faces, respectively and the other passage has a bleed fitting and a flow fitting at the first and second faces, respectively.

Preferred embodiments of the invention further include a mounting bracket having plural groups of holes, e.g., three groups, formed therein. Bolts or other fasteners are extended through each of the holes in one group for mounting the cylinder to a particular "brand" or make of outboard motor. Each of the other groups of holes is used to mount the cylinder to other makes of outboard motors.

It is highly preferred that the cylinder housing be made of extruded aluminum. Forming the housing by extrusing results in very attractive manufacturing economies.

DETAILED DESCRIPTIONS OF THE PREFERRED EMBODIMENTS

Figure 1:
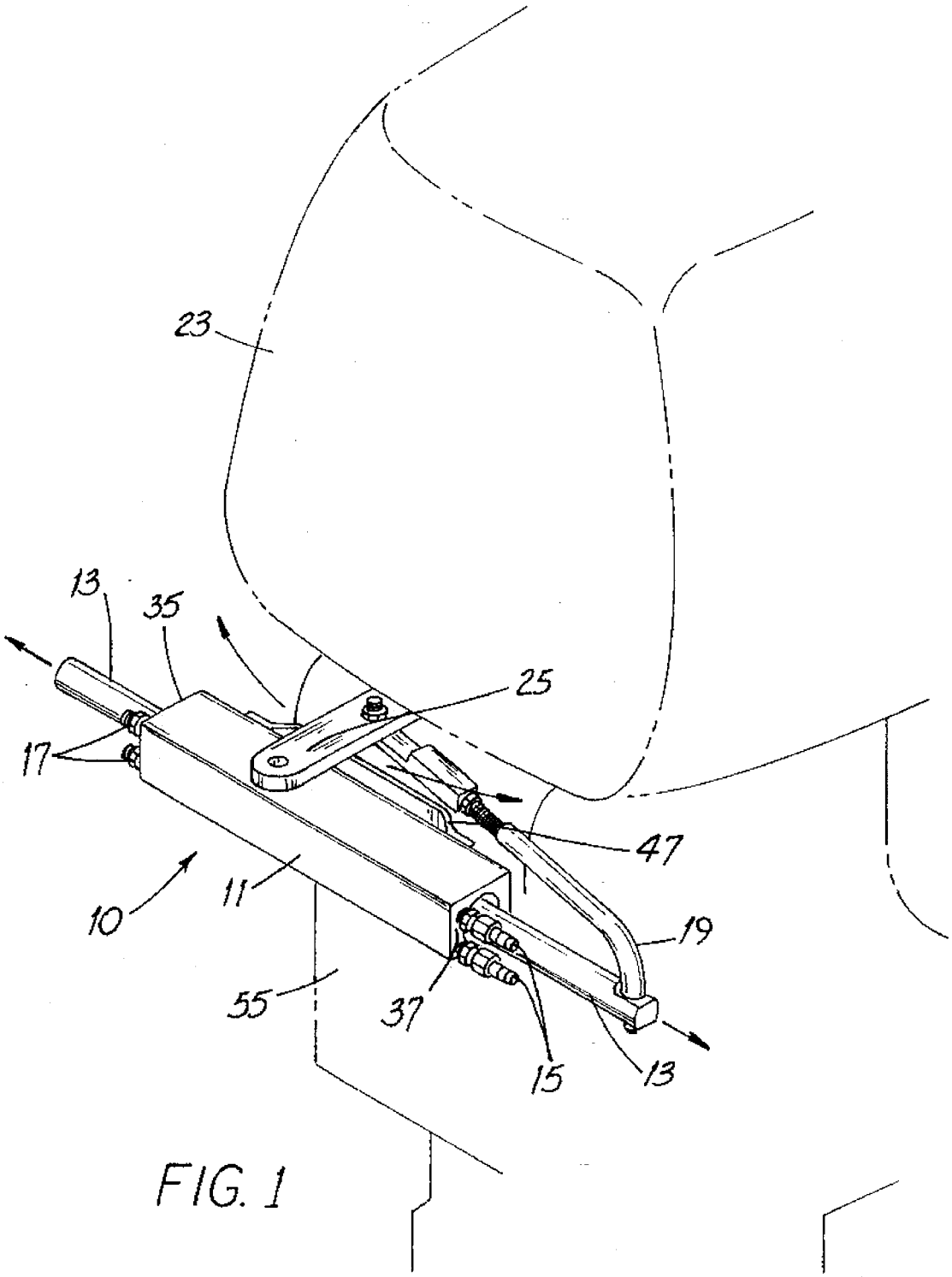
FIG. 1 is a perspective view of the improved outboard engine steering cylinder shown in conjunction with an outboard engine.

Referring first to FIG. 1, there is generally shown an improved outboard engine steering cylinder 10 embodying the present invention. Such cylinder 10 is of the "double-ended" type, so named because a rod 13 extends from each cylinder end.

Figure 4:
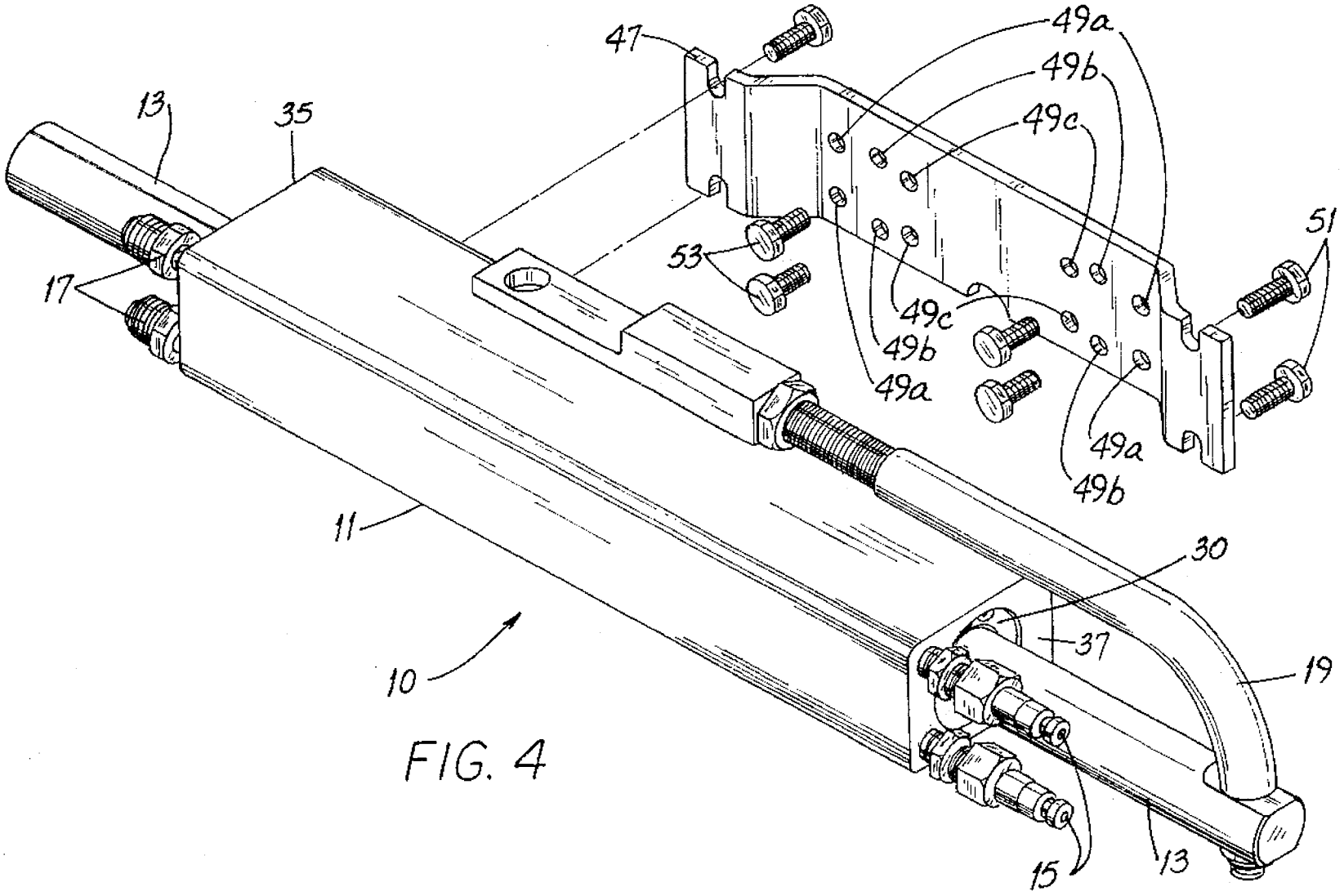
FIG. 4 is an exploded perspective view of the improved outboard engine steering cylinder showing the fittings and a plate for mounting the cylinder to an outboard engine.
Figure 5:
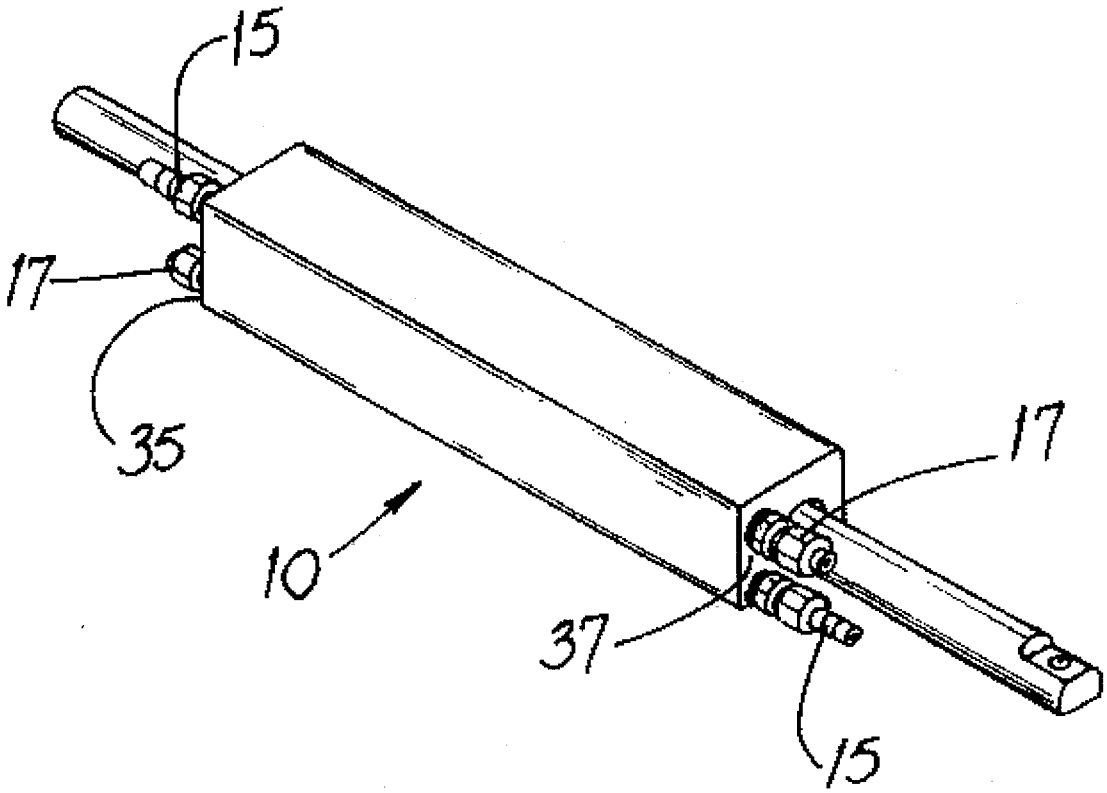
FIG. 5 is a perspective view of the steering cylinder showing an alternate arrangement for the cylinder bleed and flow fittings.

The cylinder 10 includes a housing 11, cylinder rod 13, bleed fittings 15 and hydraulic flow fittings 17. Housing 11, preferably made of extruded aluminum, is attached to outboard engine 23 by bracket 47. Cylinder rod 13 is attached to outboard engine tiller bar 25 by linkage 19 so that when the rod 13 is extended or retracted (moved right or left as shown in FIGS. 1 and 4), the tiller bar 25 and engine 23 pivot for boat steering.

Figure 2:
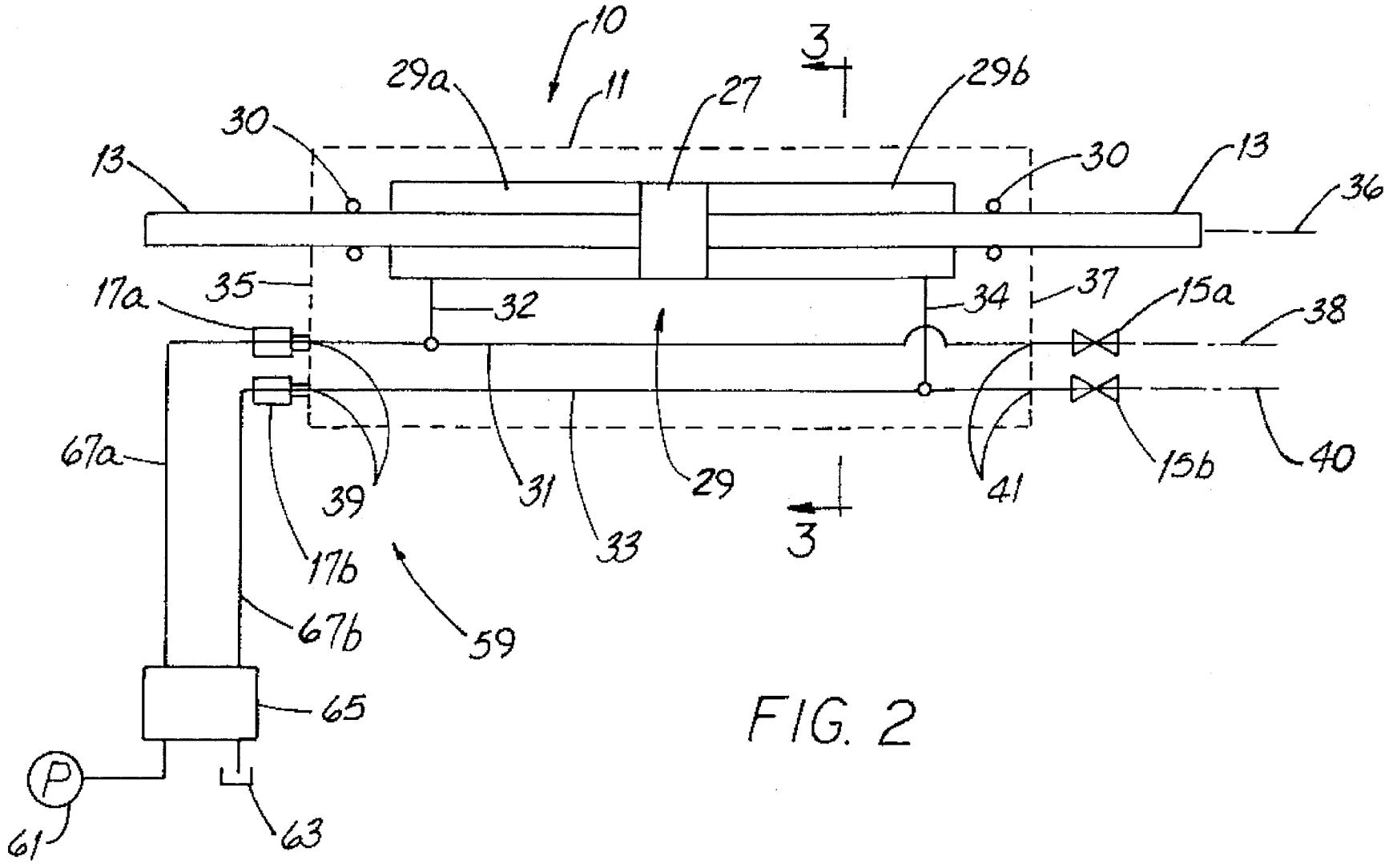
FIG. 2 is a representative cross-sectional view, like a circuit diagram, showing the internal arrangement of the improved steering cylinder and the related hydraulic steering system.

Referring now to FIG. 2, the housing 11 includes an elongate interior chamber 29, a piston 27 moveable in chamber 29 and first 31 and second 33 fluid passages generally parallel to chamber 29. The long axis 38 or 40 of at least passage 31 or 33, respectively is spaced from the long axis of chamber 29. In the depicted embodiment, the long axes 38, 40 of passages 31 and 33, respectively are both spaced from the long axis 36 of chamber 29 and are also spaced from one another.

A piston 27 divides chamber 29 into first and second chamber portions 29*a*, 29*b*, respectively. Chamber 29 is closed at each end by annular rod seals 30 through which cylinder rod 13 moves.

Passage 31 is connected by fluid path 32 to the first portion 29*a* of the chamber 29. Similarly, passage 33 is connected by fluid path 34 to the second portion 29*b* of such chamber 29. Hydraulic fluid fills passages 31 and 33, fluid paths 32 and 34 and chamber 29 and the way in which such configuration is used to pivot the engine 23 and steer the boat on which such engine 23 is mounted is described below.

The housing 11 includes first and second end faces 35, 37, respectively, which are spaced from one another. In a highly preferred arrangement, each of passages 31 and 33 has a terminus 39 at the end face 35. Similarly, each of such passages 31 and 33 has a second terminus 41 at end face 37. It is to be appreciated that while it is not mandatory for each passage 31, 33 to have a terminus 39, 41 at each end face 35, 37, respectively, such arrangement is very advantageous. The reason is described below.

Figure 3:
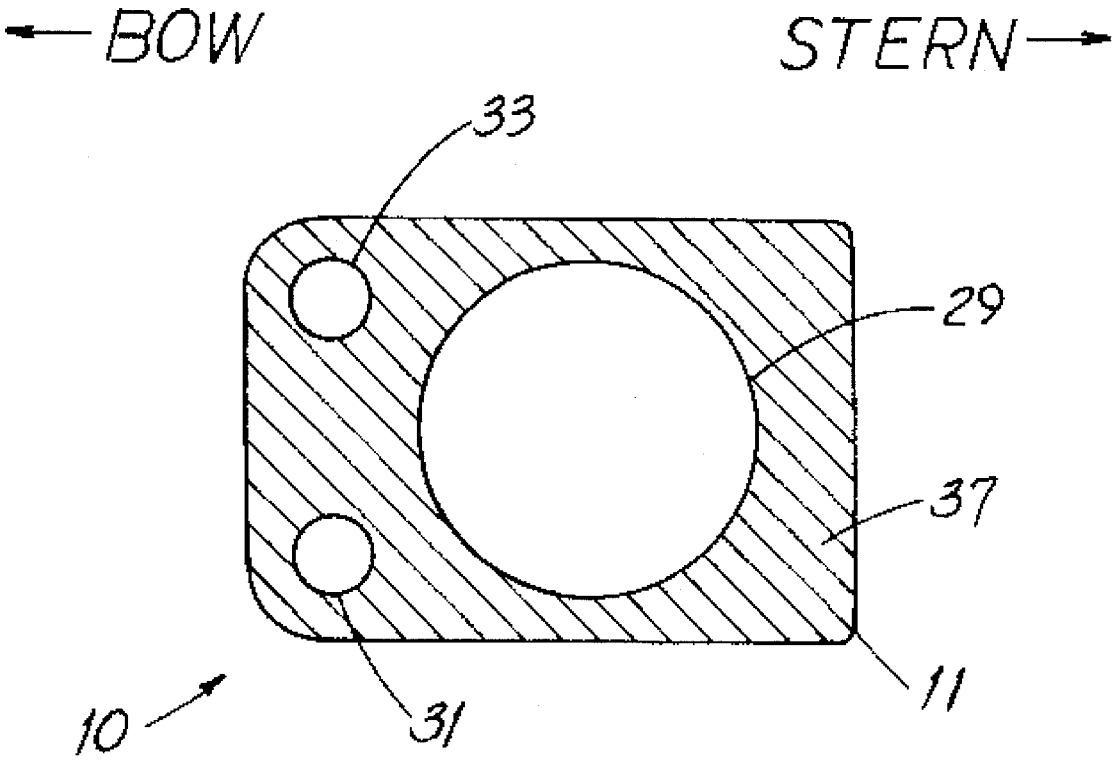
FIG. 3 is a cross-sectional view of the housing portion of the steering cylinder of FIGS. 1 and 2 taken generally along the viewing plane 3—3 of FIG. 2.

FIG. 3 shows one embodiment indicating the spatial relationship of chamber 29 and passages 31 and 33 within housing 11. The chamber 29 and the passages 31 and 33 are elongate with the passages 31, 33 being substantially parallel to chamber 29. Each passage 31, 33 is in fluid communication with a separate portion 29*a*, 29*b*, respectively, of chamber 29.

Referring next to FIG. 4, passages 31 and 33 each have a terminus at face 35 in communication with a threaded hydraulic flow fitting 17. The fittings 17 are connected to hoses or tubes (not shown) for flowing fluid into and out of passages 31 and 33. Each of passages 31 and 33 may also have a second terminus at face 37 in communication with a bleed fitting 15. The fittings 15 are used to bleed air from the chamber 29 and passages 31 and 33 during installation or while performing maintenance.

The manner in which the steering cylinder 10 is mounted to an outboard engine 23 will now be described. Referring particularly to FIGS. 1 and 4, such cylinder 10 includes a mounting bracket 47 attached to the cylinder housing by cap screws 51. In turn, the bracket 47 is secured to the forward portion 55 of the engine 23 by cap screws 53. Preferably, the bracket 47 is somewhat "dished" to permit access to the cap screws 53 with a wrench.

Another innovative feature of the new cylinder 10 involves the bracket 47 which has a plurality of holes 49 for the cap screws 53. Referring particularly to FIG. 4, in a highly preferred arrangement, there are plural groups of holes, e.g., groups 49*a*, 49*b* and 49*c*. The holes of each group 49*a*, 49*b* or 49*c* are sized and located to correspond with the size and location of bracket mounting holes for outboard engines manufactured by each of three different companies. In the illustrated embodiment, the groups 49*a*, 49*b* and 49*c* fit outboard engines made by Mercury, Outboard Marine Corporation and Yamaha, respectively. This configuration enables a single steering cylinder to be used in conjunction with a variety of engines.

Referring again to FIG. 2, the exemplary boat steering system 59 includes a pump 61, a tank or reservoir 63 and a valving device 65 for alternately directing high pressure hydraulic fluid to fitting 17*a* or 17*b*. In practice, the device 65 may be embodied in and part of the boat steering wheel mechanism. But for the innovative cylinder 10 and its different aspects, systems like system 59 are in common use.

In operation, it is assumed that hydraulic fluid lines 67*a*, 67*b* are connected to the fittings 17*a*, 17*b*, respectively. It is also assumed that the cylinder 10 is newly-installed and that both chamber portions 29*a*, 29*b*, the passages 31, 33 and the paths 32, 34 are filled with air. To operate the system 59, such chamber portions 29*a*, 29*b*, passages 31, 33 and paths 32, 34 must be bled free of air (which is compressible) and filled with hydraulic fluid which is relatively incompressible. Such bleeding is needed to avoid imparting a "spongy" feeling to the system 59.

To accomplish the foregoing, hydraulic fluid under pressure (e.g., oil) from the pump 61 is admitted into line 67*a* and fitting 17*a*. Simultaneously, fitting 17*b* and line 67*b* are connected to the reservoir 63 which is at or near atmospheric pressure. When initially flowing pressurized oil along line 67*a*, the bleed fitting 15*a* is opened so that air in such line, in the fitting 17*a* and in passage 31 is expelled from the system 59.

It will be noted that when high pressure oil is introduced into passage 31, path 32 and chamber 29*a*, the piston 27 is urged to the right. The volume of the chamber 29*a* increases and, significantly, the volume of chamber 29*b* (which is then filled with air) decreases. To permit the air in chamber 29*b*, in path 34 and some air in passage 33 to be expelled, bleed fitting 15*b* is also opened.

When the piston 27 reached the end of its rightward travel, the device 65 is manipulated to then introduce high pressure oil from the pump 61 into line 67*b* and to connect line 67*a* to the reservoir 63. The bleed fitting 15*b* is permitted to close and the piston 27 is then urged leftward to the end of its travel. This "back and forth" cycling of the cylinder 10 is carried out while opening and closing the bleed fittings 15*a*, 15*b* at appropriate times so that, shortly, all of the air is purged from the system 59 which is then ready for boat steering.

The design and configuration of the new steering cylinder 10 is particularly useful in decreasing the time and effort necessary to "set up" the system 59. In prior art systems, the same fitting (like fitting 17*a*) is used for both introduction of high pressure oil and air bleeding. This requires periodic disconnection or at least loosening of the supply lines 67 therefrom. Oil leaks from the loosened fitting and set-up is a messy and time-consuming task.

It is also to be appreciated that the locations of the bleed fittings 15 and hydraulic flow fittings 17 at the end faces 35, 37, respectively, are very advantageous. Being located as such faces 35, 37, such fittings 15, 17 are not likely to be mashed against the boat transom or the engine 23 when such engine 23 is tilted out of the water. And the new cylinder 10 is configured to be readily adapted to any of a variety of makes of outboard engines 23.

It is to be appreciated that having the fittings 17 at face 35 and the fittings 15 at face 37 is but one of other possible arrangements. For example, the fittings 15 may be at face 35 and the fittings 17 at face 37. Or one passage such as passage 31 may have its flow fitting 17 at the face 35 and its bleed fitting 15 at the face 37. The other passage, e.g., passage 33, has its flow fitting 17 at the face 37 and its bleed fitting 15 at the face 35. The configuration of the particular boat and of other parts of the system 59 largely determines how the fittings 15, 17 are located.

While the principles of this invention have been described in connection with specific embodiments, it should be understood clearly that these descriptions are made only by way of example and are not intended to limit the scope of the invention.

What is claimed:

1. In combination, a valving device and a pump, tank and hydraulic cylinder remote from the valving device and coupled thereto by hydraulic lines, the cylinder comprising:

a housing having first and second end faces formed thereon;

an elongate chamber in the housing;

a piston movably disposed in the chamber and dividing the chamber into first and second portions;

a separate rod attached to the piston and protruding through each end face;

first and second fluid passages formed in the cylinder housing, each passage being in fluid communication with a separate portion of the chamber, and wherein:

the cylinder housing has a flow fitting attached thereto, such flow fitting being in flow communication with the valving device, the first passage and the first portion;

the cylinder housing has a bleed fitting attached thereto, such bleed fitting being in flow communication with the second passage and the second portion.

2. The invention of claim 1 wherein each passage has a first end which terminates in a hydraulic flow fitting.

3. The invention of claim 2 wherein each passage has a second end which terminates in a bleed fitting.

4. The invention of claim 3 wherein:

the flow fitting is a first flow fitting and the bleed fitting is a second bleed fitting;

the cylinder housing has a second flow fitting and a first bleed fitting attached thereto;

the first passage is terminated by the first flow fitting and the first bleed fitting;

the second passage is terminated by the second flow fitting and the second bleed fitting; and for each passage, its hydraulic flow fitting and its bleed fitting are positioned at opposing end faces.

5. The invention of claim 1 in further combination with an outboard motor and further including a mounting bracket having plural groups of holes formed therein and wherein fasteners extend only through holes in a single group for mounting the cylinder to the outboard motor.

6. The invention of claim 5 wherein the mounting bracket has three groups of holes, one group identified to each of three manufacturers of outboard motors.

7. The invention of claim 1 wherein the cylinder is made of extruded aluminum.

8. In a hydraulic cylinder having (a) an elongate interior chamber, (b) a piston movable in the chamber, and (c) a first fluid passage along a first axis generally parallel to the chamber, the improvement wherein:

the cylinder includes a second fluid passage along a second axis which is non-coincident with and laterally spaced from the first axis;

fluid flows in the passages for controlling the position of the piston in the chamber;

the cylinder includes a housing having a long axis and first and second end faces spaced from one another;

the end faces are oriented to intersect the long axis; and each passage has a terminus at each end face.

9. In a hydraulic cylinder having (a) an elongate interior chamber, (b) a piston movable in the chamber, and (c) a first fluid passage along a first axis generally parallel to the chamber, the improvement wherein:

the cylinder includes a second fluid passage along a second axis which is non-coincident with and laterally spaced from the first axis;

fluid flows in the passages for controlling the position of the piston in the chamber;

the cylinder includes a housing having a long axis and first and second end faces spaced from one another;

the end faces are oriented to intersect the long axis; and each passage has a terminus at one end face; and the cylinder includes a hydraulic flow fitting in communication with each passage terminus and positioned at one end face.

10. The invention of claim 9 further including a bleed fitting in communication with each passage terminus and positioned at one end face.

11. The invention of claim 9 wherein the cylinder housing is made of extruded aluminum.

12. In a hydraulic cylinder having (a) an elongate interior chamber, (b) a piston movable in the chamber, and (c) a first fluid passage along a first axis generally parallel to the chamber, the improvement wherein:

the cylinder includes a second fluid passage along a second axis which is non-coincident with and laterally spaced from the first axis;

fluid flows in the passages for controlling the position of the piston in the chamber;

the cylinder includes a housing having a long axis and first and second end faces spaced from one another;

the end faces are oriented to intersect the long axis;

each passage has two termini, one at each end face; and each passage includes a hydraulic flow fitting at the first end face and a bleed fitting at the second end face.

13. In a hydraulic cylinder having (a) an elongate interior chamber, (b) a piston movable in the chamber, and (c) a first fluid passage along a first axis generally parallel to the chamber, the improvement wherein:

the cylinder includes a second fluid passage along a second axis which is non-coincident with and laterally spaced from the first axis;

fluid flows in the passages for controlling the position of the piston in the chamber;

the cylinder includes a housing having a long axis and first and second end faces spaced from one another;

the end faces are oriented to intersect the long axis;

each passage has two termini, one at each end face, the first passage includes a hydraulic flow fitting at the first end face and a bleed fitting at the second end face; and the second passage includes a bleed fitting at the first end face and a hydraulic flow fitting at the second end face.

14. In a hydraulic cylinder having (a) an elongate interior chamber, (b) a piston movable in the chamber, and (c) a first fluid passage along a first axis generally parallel to the chamber, the improvement wherein:

the cylinder includes a second fluid passage along a second axis which is non-coincident with and laterally spaced from the first axis;

fluid flows in the passages for controlling the position of the piston in the chamber;

the cylinder includes a mounting bracket having plural groups of holes formed therein and wherein fasteners extend through each of the holes in only one group for mounting the cylinder to an outboard motor manufactured by a particular company.

15. The invention of claim 14 wherein the mounting bracket has three groups of holes and each group is used to mount the cylinder to a different brand of outboard motor.

* * * * *